United States Patent [19]

Ichikawa et al.

[11] Patent Number: 4,887,531

[45] Date of Patent: Dec. 19, 1989

[54] INTERCHANGEABLE DRUM UNIT TYPE ROTARY PRINTING MACHINE

[75] Inventors: Haruo Ichikawa, Tokyo; Ryoichi Kanno; Masayuki Kiyomiya, both of Chiba, all of Japan

[73] Assignee: Miyakoshi Printing Machinery Co., Ltd., Tokyo, Japan

[21] Appl. No.: 266,762

[22] Filed: Nov. 3, 1988

[30] Foreign Application Priority Data

Nov. 6, 1987 [JP] Japan ..... 62-169015[U]

[51] Int. Cl.[4] ..... B41F 5/00

[52] U.S. Cl. ..... 101/216; 101/DIG. 35

[58] Field of Search ..... 101/212, 216, 218, 220, 101/152, 153, 177, 178, 181, 182, 143, 139, DIG. 35

[56] References Cited

U.S. PATENT DOCUMENTS

| | | | |
|---|---|---|---|
| 3,041,966 | 7/1962 | Polglase, Jr. | 101/139 |
| 3,323,452 | 6/1967 | Pasquinelli | 101/218 |
| 3,470,816 | 10/1969 | Piecha et al. | 101/216 |
| 3,759,177 | 9/1973 | Gazzola et al. | 101/152 |
| 3,892,178 | 7/1975 | Staamann | 101/177 |
| 4,111,120 | 9/1978 | Paulson | 101/177 |
| 4,346,655 | 8/1982 | Suter et al. | 101/216 |
| 4,502,384 | 3/1985 | Habluetzel | 101/216 |
| 4,616,564 | 10/1986 | Fadas et al. | 101/143 |

*Primary Examiner*—Eugene H. Eickholt

*Attorney, Agent, or Firm*—Armstrong, Nikaido, Marmelstein, Kubovcik & Murray

[57] ABSTRACT

A rotary printing machine body is provided with a U-shaped longitudinal portion for mounting an interchangeable drum unit. A pair of left and right interchangeable drum unit moving devices are mounted on the left and right printing machine body frames and adapted to move an interchangeable drum unit resting on a carriage into the mounting portion formed in the printing machine body and to move an interchangeable drum unit from the mounting portion onto the carriage. A pair of left and right fixing devices are also provided for fixing the interchangeable drum unit in the mounting portion to the printing machine body.

4 Claims, 5 Drawing Sheets

INTERCHANGEABLE DRUM UNIT TYPE ROTARY PRINTING MACHINE

BACKGROUND OF THE INVENTION

1. Field of the Invention:

This invention relates to a rotary printing machine, and particularly to an interchangeable drum unit type rotary printing machine arranged to enable the interchange of a plurality of interchangeable drum units to be effected very easily.

2. Description of the Prior Art:

In an interchangeable drum unit type rotary printing machine, the time required for the interchange of an interchangeable drum unit occupies a great part in the operation for changing from the previous printing work to the next one.

The interchange work of the interchangeable drum unit in the prior art has involved such working process that a skilled worker manually draws a used interchangeable drum unit out of a printing machine, carries it up to an interchangeable drum unit set table while loaded on an interchange carriage or suspended by a winch, places the used interchangeable drum unit on the set table, subsequently transfers a new interchangeable drum unit to be used in the next printing work which has been carried to the vicinity of the printing machine by another interchange carriage or winch, and mounts the new interchangeable drum unit on the printing machine.

In the case where there are a large number of printing units as in the case of a multi-color printing machine, or the interchangeable drum unit is heavy, the manual interchange work would necessitate a lot of time and labor, thus lowering the printing work efficiency. In particular, in case where the interchangeable drum unit is very heavy, it is impossible to interchange the interchangeable drum unit manually, and further there is a possibility of endangering the life of the worker engaged in the interchanging operation.

SUMMARY OF THE INVENTION

The present invention has been made in view of the foregoing circumstances in the prior art interchangeable drum unit type rotary printing machine, and has for its aim to provide a novel interchangeable drum unit type rotary printing machine in which a used interchangeable drum unit can be removed therefrom in a mechanical manner and a new interchangeable drum unit can be set up therein in a mechanical manner, thereby remarkably shortening the time required for the interchange of the interchangeable drum unit and releasing the worker from heavy labor and dangerous work.

In order to achieve the above-mentioned aim, according to a first aspect of the present invention, there is provided an interchangeable drum unit type rotary printing machine, comprising an interchangeable drum unit mounting portion having an approximately C-shaped vertical section, which is formed substantially in the intermediate part of the front of the rotary printing machine body having a pair of left and right body frames spaced apart with each other on both sides thereof, the arrangement being such that an interchangeable drum unit having a plurality of transversely extending blanket and plate cylinders supported between the pair of left and right interchangeable drum unit frames spaced apart with each other on both sides thereof is mounted in the mounting portion so that it may be replaced with another one and positioned transversely when it is mounted therein; an interchangeable drum unit adapted to be mounted in the interchangeable drum unit mounting portion; a pair of left and right interchangeable drum unit moving devices adapted to move an interchangeable drum unit resting on an interchangeable drum unit carriage which is located in close proximity to the front of the printing machine body into the mounting portion formed in the printing machine body or to move an interchangeable drum unit mounted in the mounting portion onto the carriage; and a pair of left and right interchangeable drum unit fixing devices for fixedly securing the interchangeable drum unit which has been inserted in the mounting portion to the printing machine body.

According to the second aspect of the present invention, there is provided an interchangeable drum unit type rotary printing machine, wherein said interchangeable drum unit as set forth in the first aspect thereof comprises a pair of left and right projecting members fixedly secured to the lower end faces of the pair of left and right interchangeable drum unit frames so as to extend along the lower end faces; a plurality of feed blocks fixedly secured to the lower end of the inside surface of each of the pair of interchangeable drum unit frames in a horizontal row and at intervals of equal spacing; and a stationary shaft located at approximately longitudinally intermediate part of the interchangeable drum unit mounting portion and at the rear of the interchangeable drum unit and extending transversely between the pair of interchangeable drum unit frames; and further each of the interchangeable drum unit moving devices comprises a guide groove formed on the bottom surface of the lower part of the interchangeable drum unit mounting portion and located on the left body frame or the right body frame, the guide groove extending in the direction of insertion and removal of the interchangeable drum unit so as to fit therein one or the other projecting member of the interchangeable drum unit; a plurality of turning shafts mounted on the outside surface of said body frame located adjacent to and below the guide groove, at right angles thereto and in a horizontal row and at intervals of equal spacing; a plurality of eccentric cams formed integrally with the inner ends of the turning shafts and located in the groove; a plurality of rollers fitted outside of the eccentric cams, respectively, so as to rotate freely; a plurality of levers, one end of each of which is fixedly secured to the outer end of each of the plurality of turning shafts; a connecting lever for connecting the other end of each of the levers; a first actuator whose leading end is pivotally connected to the other end of one of the plurality of levers and whose base or trailing end is pivotally connected to the side surface of the body frame; a feed wheel located in the lower part of the interchangeable drum unit mounting portion and supported rotatably on a shaft fixedly secured to the inside surface of the body frame so as to project inside of the body frame; a driven sprocket supported on the support shaft of the feed wheel connected integrally to the feed wheel so as to rotate synchronously with the feed wheel; and a rotating drive means for rotatively driving the driven sprocket; and each of the interchangeable drum unit fixing devices comprising a sliding piece located at approximately longitudinally intermediate part of the interchangeable drum unit mounting portion and inwardly relative to the direction of insertion and removal of the interchangeable drum unit so as to be connected to the stationary shaft mounted on the interchangeable drum unit, said sliding piece being arranged to be guided by a horizontal guide, which is fixedly secured to the inside surface of the left body frame or the right body frame, and slidably supported in the horizontal direction; a common turning shaft having as an integral unit thereof an eccentric cam, which is inserted rotatably in an aperture formed in one end of the sliding piece, and extending transversely between the pair of left and right body frames; a lever whose one end is connected to one end of the turning shaft projecting outside of one of the body frames; a second actuator whose leading end is connected to the other end of the lever and whose base or trailing end is pivotally connected to the outside surface of the body frame at a proper position; and a locking mechanism mounted on the leading end of the sliding piece.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
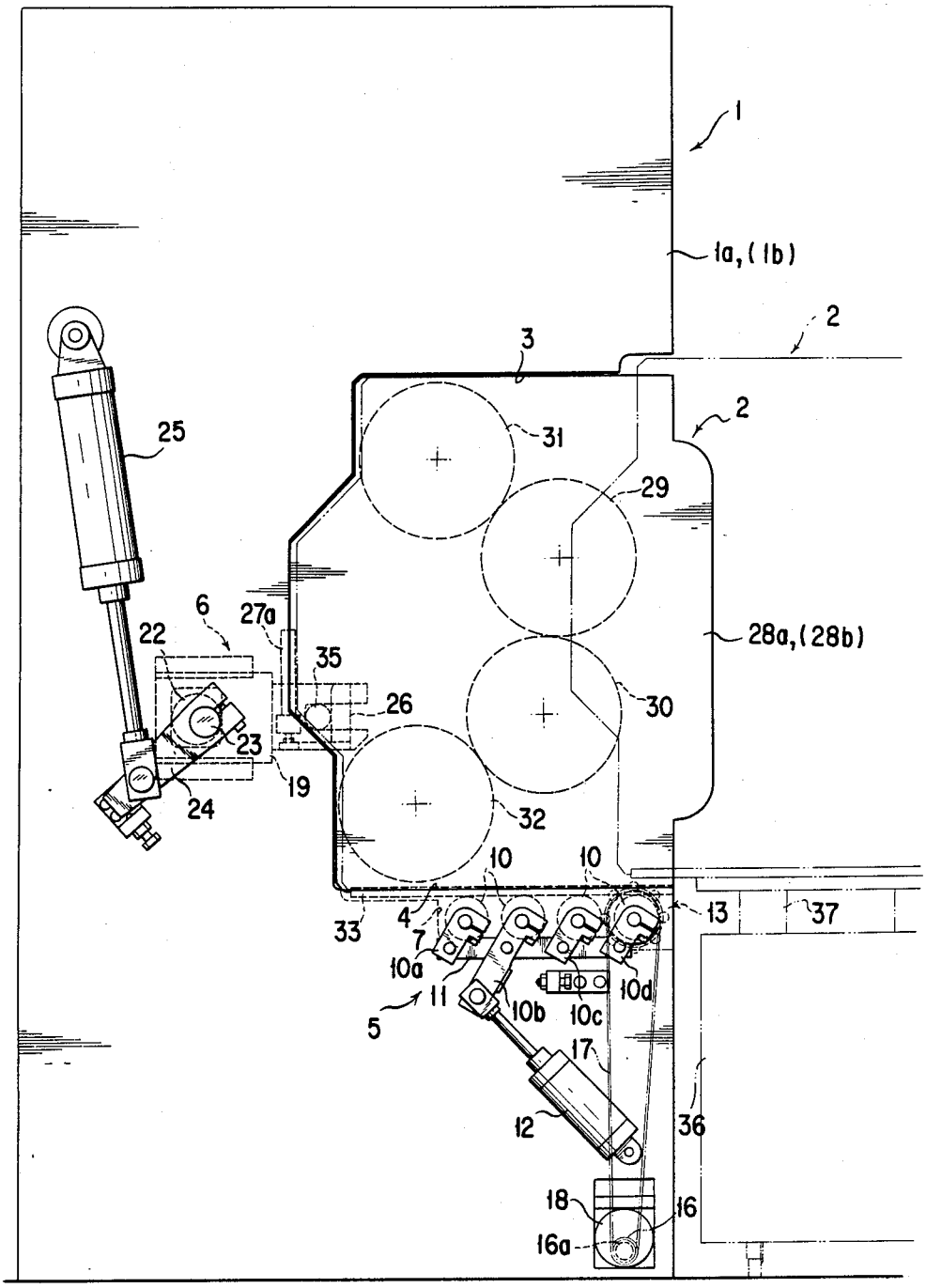
FIG. 1 is a schematic side elevational view of an interchangeable drum unit type rotary printing machine according to the present invention.
Figure 2:
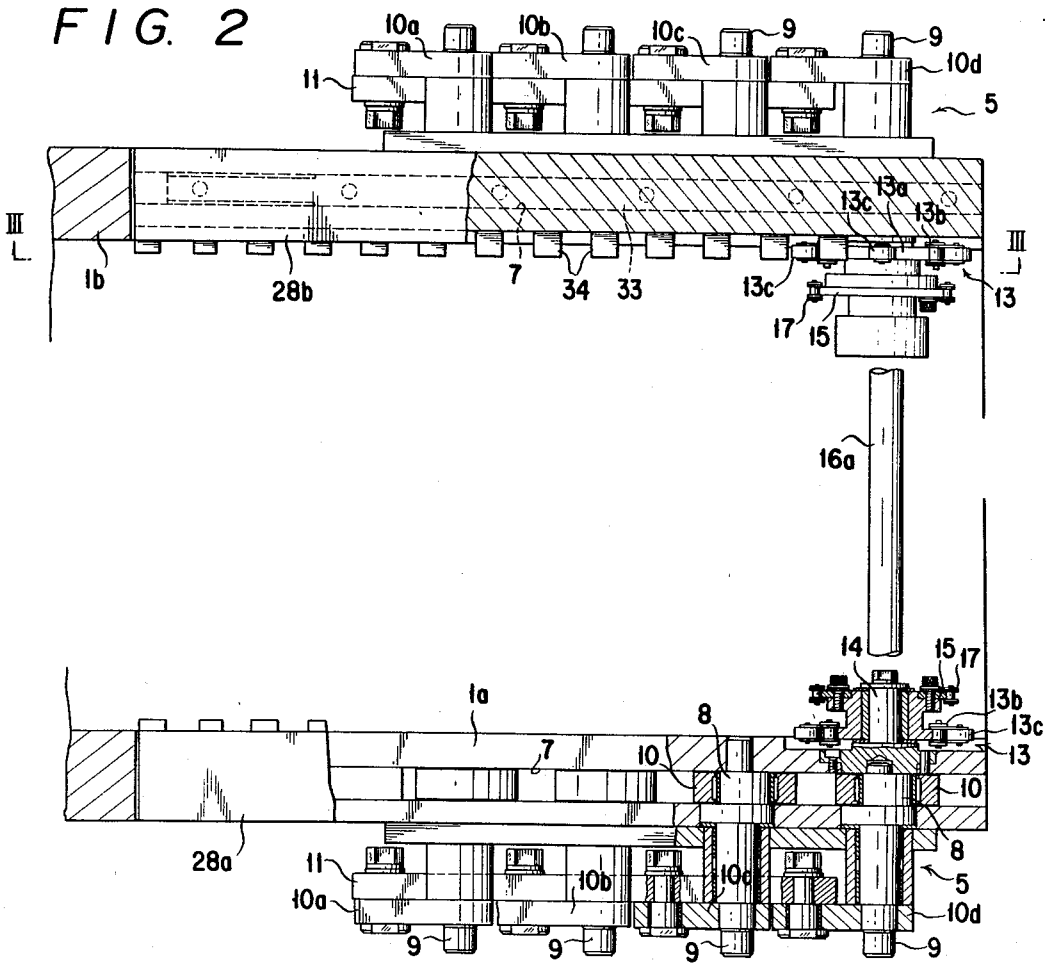
FIG. 2 is a partially cutaway, schematic plan view of a moving device for the interchangeable drum unit.

The present invention will now be described below by way of a preferred embodiment thereof with reference to the accompanying drawings.

In the drawings, reference numeral 1 denotes the body of the interchangeable drum unit type rotary printing machine, and 2 an interchangeable drum unit mounted on the body 1 of the printing machine in an interchangeable manner.

The above-mentioned printing machine body 1 comprises opposed left and right body frames 1*a* and 1*b* which are spaced apart in the transverse direction relative to the direction of running of a printing paper. Formed in both the body frames 1*a* and 1*b* is an interchangeable drum unit mounting portion 3 having an approximately U-shaped longitudinal section, in which the above-mentioned interchangeable drum unit 2 is mounted. Further, the bottom surface 4 of the lower portion of this interchangeable drum unit mounting portion 3 is formed horizontally. Further, moving devices 5 for the interchangeable drum unit are mounted below the bottom surface 4, and also fixing devices 6 for the interchangeable drum unit 2 are mounted in the longitudinal, approximately intermediate and innermost portion of the interchangeable drum mounting portion 3.

The interchangeable drum unit moving devices 5 are constructed as shown in FIGS. 1 to 4. The interchangeable drum unit moving devices 5 are identical in construction and mounted symmetrically on the left and right body frames 1*a* and 1*b*, and so only one of them will be described below.

The interchangeable drum unit mounting portion 3 has grooves 7 formed on the bottom surface 4 of the lower portion of the interchangeable drum unit mounting portion 3 and which extends in the direction of insertion and removal of the interchangeable drum unit. A plurality of, for example, four pieces of eccentric cams 8 are located in each of the grooves 7. Each of the eccentric cams 8 is fitted to a turning shaft 9 as an integral unit thereof. A roller follower 10 is fitted outside of each of the eccentric cams 8 in such a manner that it may be rotated freely. Each of the above-mentioned turning shafts 9 projects outside the body frames 1*a*. The turning shafts 9 have levers 10*a*, 10*b*, 10*c* and 10*d*, respectivley, one end of each of which is fixedly secured to one end of each of the shafts. The levers 10*a*, 10*b*, 10*c* and 10*d* are interconnected by means of a connecting lever 11. Further, the leading end of the lever 10*b* is pivotally connected to the leading end of an air cylinder means 12 whose base or trailing end is pivotally connected to the body frame 1*a*. The arrangement is made such that by extending and retracting a piston rod in the air cylinder 12 so as to swing the latter each of the turning shafts 9 may be synchronously turned through the connecting lever 11 and each of the levers 10*a* to 10*d*. Further, the arrangement is made such that turning of each of the turning shafts 9 when the piston rod in the air cylinder means 12 is retracted allows the upper peripheral surface of each of the roller followers 10 to be moved upwards by a predetermined dimension, for example 0.5 mm.

Inside the lower portion of the inlet of the interchangeable drum unit mounting portion 3, there is provided a feed wheel 13 which is supported on a shaft 14 fixedly secured to the body frame 1*a*. The feed wheel 13 comprises a sprocket 13*a*, and a roller chain 13*b* which is wound round the sprocket 13. Rollers 13*c* mounted on the roller chain 13*b* serve as feed teeth. The feed wheel 13 comprises a driven sprocket 15 which is located concentrically. A chain 17 is wound round the driven sprocket 15 and a driven sprocket 16 journalled in the lower part of the body frame 1*a*. Both of the drive sprockets 16, 16 journalled in the left and right body frames 1*a* and 1*b* are connected by means of a common drive shaft 16 and are arranged to be synchronously driven. An electric motor 18 is connected to one end of the drive shaft 16*a*.

The interchangeable drum unit fixing devices 6 mounted in the inner part of the interchangeable drum unit mounting portion 3 are arranged as shown in FIG. 1 and FIGS. 5 to 7. The fixing devices 6 have the same construction and are located symmetrically inside the left and right body frames 1*a* and 1*b*, and so only one of them will be described below.

Inside the body frame 1*a*, a sliding piece 19 is guided by a guide 20, which is fixedly secured to the body frame 1*a*, and supported so that it may be slidably moved freely in the horizontal direction. This sliding piece 19 has an aperture in the form of a rectangular hole 21 formed therein, in which an eccentric cam 22 is fitted. The arrangement is made such that when the eccentric cam 22 is turned about a turning shaft 23 the sliding piece 19 may be reciprocated horizontally over a distance "e". The above-mentioned turning shaft 23 is formed integrally with the left and right eccentric cams 23. One end of the turning shaft 23 projects outside of the body frame 1*a* and is fixedly secured to one end of a lever 24. The other end of this lever 24 is connected to the leading end of the air cylinder means 25 which is supported by the body frame 1*a*. When the air cylinder means 25 is actuated so as to retract its piston rod, the sliding piece 19 is moved in the direction of pushing out the interchangeable drum unit 2, whilst when the air cylinder means 25 is actuated so as to extend its piston rod, the sliding piece 19 is moved in the direction of inserting the interchangeable drum unit 2.

The leading end of the above-mentioned sliding piece 19 is provided with a locking mechanism extending into the interchangeable drum unit mounting portion 3. This locking mechanism has a yoke shaped portion formed in the leading end of the sliding piece 19. A locking rod 26 adapted to close the yoke shaped portion is mounted on the leading end of the yoke shaped portion so that it may be slidably moved freely in the vertical direction. The base end of this locking rod 26 is connected through a connecting member 27 to an air cylinder means 27*a* which is mounted on the base end of the yoke shaped portion in such a manner that it may be actuated so as to extend and retract its piston rod. Reference numeral 26*a* denotes a guide rod mounted on the base end of the yoke shaped portion so that it may be slidably moved freely in the vertical direction.

The interchangeable drum unit 2 is comprised of left and right interchangeable drum unit frames 28*a* and 28*b* which are spaced apart at the same space interval as that between the left and right body frames 1*a* and 1*b* of the printing machine, two blanket cylinders 29 and 30 which span and are supported between the frames 28*a* and 28*b* and which are kept in contact with each other, and two plate cylinders 31 and 32 which are kept in rolling contact with the blanket cylinders 31 and 32, respectively. The arrangement is made such that when a printing paper is passed through between the blanket cylinders 29 and 30 it may be printed on the front and rear surface thereof. The above-mentioned cylinders 29, 30, 31 and 32 are operatively connected by means of gears not shown, and arranged to be rotated synchronously. The uppermost cylinder 31 is connected to a drive gear mounted on the printing machine body 1.

Fixedly secured to the lower end surfaces of the left and right interchangeable drum unit frames 28*a* and 28*b* of the interchangeable drum unit 2 are projecting members 33 which are adapted to fit in the grooves 7 formed in the bottom surfaces 4 of the lower parts of the above-mentioned body frames 1*a* and 1*b*, respectively. (Refer to FIGS. 1 and 2). Further, a plurality of feed blocks 34 are mounted on the inside surfaces of the lower parts of the interchangeable drum frames 28*a* and 28*b* in such a manner that they may mesh with the feed wheels 13 at the same pitch as that between the rollers 13*c* of the feed wheels 13. (Refer to FIGS. 2 and 3) The lower surfaces of the above-mentioned projecting members 33 are kept in contact with the upper peripheral surfaces of the roller followers 10 and are arranged to be moved upwards by means of the roller followers 10.

Further, in the inner side of the interchangeable drum unit 2, there is a stationary shaft 35 which extends transversely between the frames 28*a* and 28*b* and which is adapted to fit in the yoke shaped portions of the sliding pieces 19 of the fixing devices 6 mounted on the side of the body 1 of the printing machine. (Refer to FIGS. 1 and 5). Further, the stationary shaft 35 is fitted in the above-mentioned yoke shaped portion such that some vertical allowance is obtained. Further, the length of the stationary shaft 35 is not to be limited to that which is required to connect the interchangeable drum unit frames 28*a* and 28*b*, and it is possible to allow the stationary shaft 35 to project from the frames 28*a* and 28*b*, respectively, by a predetermined length. Further, the inside portions in the inner parts of both the interchangeable drum unit frames 28*a* and 28*b* are located opposite to the outside surfaces of the sliding pieces 19 of the fixing devices 9 leaving no space between them so that upon mounting the interchangeable drum unit 2 its transverse positioning may be made.

The operation of the above-mentioned arrangement will be described hereinbelow.

(I) Mounting of interchangeable drum unit:

An interchangeable drum unit 2 resting on a platform car 36 is conveyed in front of the interchangeable drum unit mounting portion 3. At that time, as shown by two-dot chain lines in FIG. 1, the interchangeable drum unit 2 is raised at such a height as the lower end thereof is somewhat spaced apart from the bottom surface 4 of the lower part of the interchangeable drum unit mounting portion 3, and is conveyed in the latter in the condition that the inner side of the interchangeable drum unit 2 is partially inserted in the mounting portion 3.

Further, at that time, the air cylinder means 12 for the interchangeable drum unit moving devices 5 are actuated so as to retract their piston rods to thereby move the roller followers 10, and the air cylinder means 25 for the fixing devices 6 are actuated so as to retract their piston rods to thereby push out the sliding pieces 19.

Subsequently, a lift means 37 mounted on the car truck 34 is lowered so as to allow the projection members 33 fixedly secured to the lower end face of the interchangeable drum unit 2 to fit in the grooves 7, 7 formed in the frames 1*a* and 1*b*, respectively, and allow the lower surface thereof to be brought into contact with the upper, peripheral surface of each of the cam followers 10. In this condition, the lower end faces of both the interchangeable drum unit frames 28*a* and 28*b* are spaced apart from the bottom surface 4 of the lower part of the interchangeable drum unit mounting portion 3 of the body 1 by the amount of upward movement of the cam followers 10. Further, in this condition, one piece of the rollers 13*c* of the feed wheel 13 will mesh with the block 34 for feeding the interchangeable drum unit 2.

Figure 3:
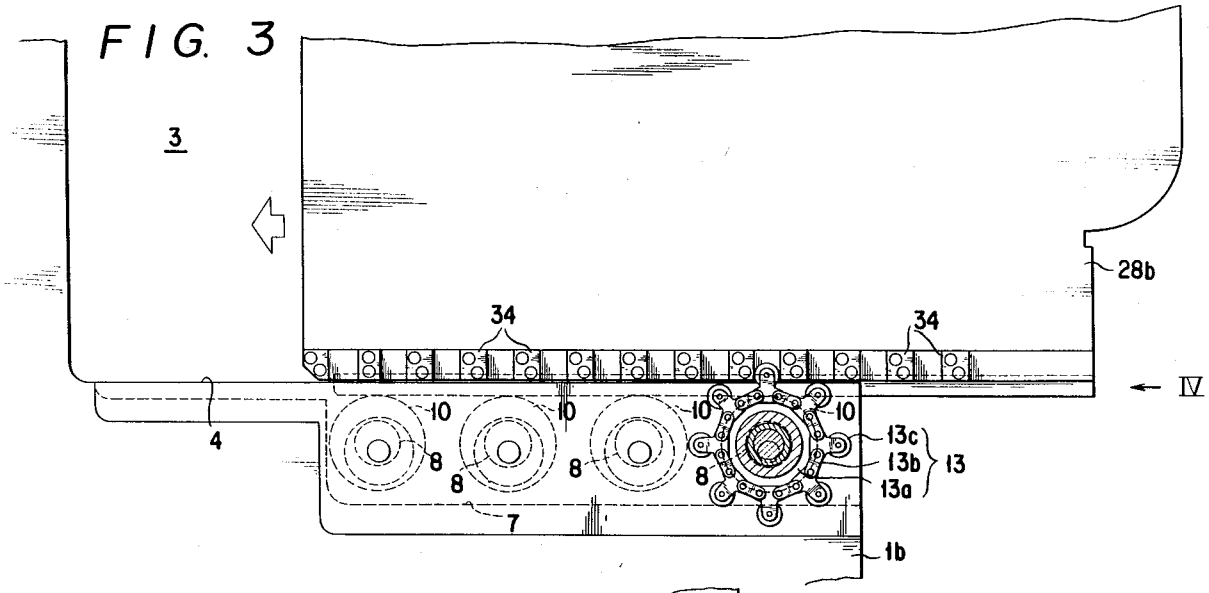
FIG. 3 is a schematic, side elevational view showing the operation for mounting the interchangeable drum unit taken along line III—III in FIG. 2.
Figure 4:
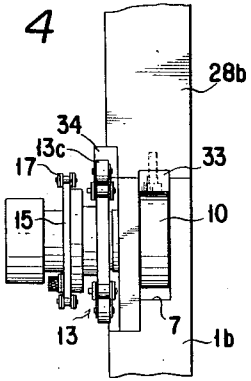
FIG. 4 is an end view of a part of the invention taken in the direction shown by arrow IV in FIG. 3.
Figure 5:
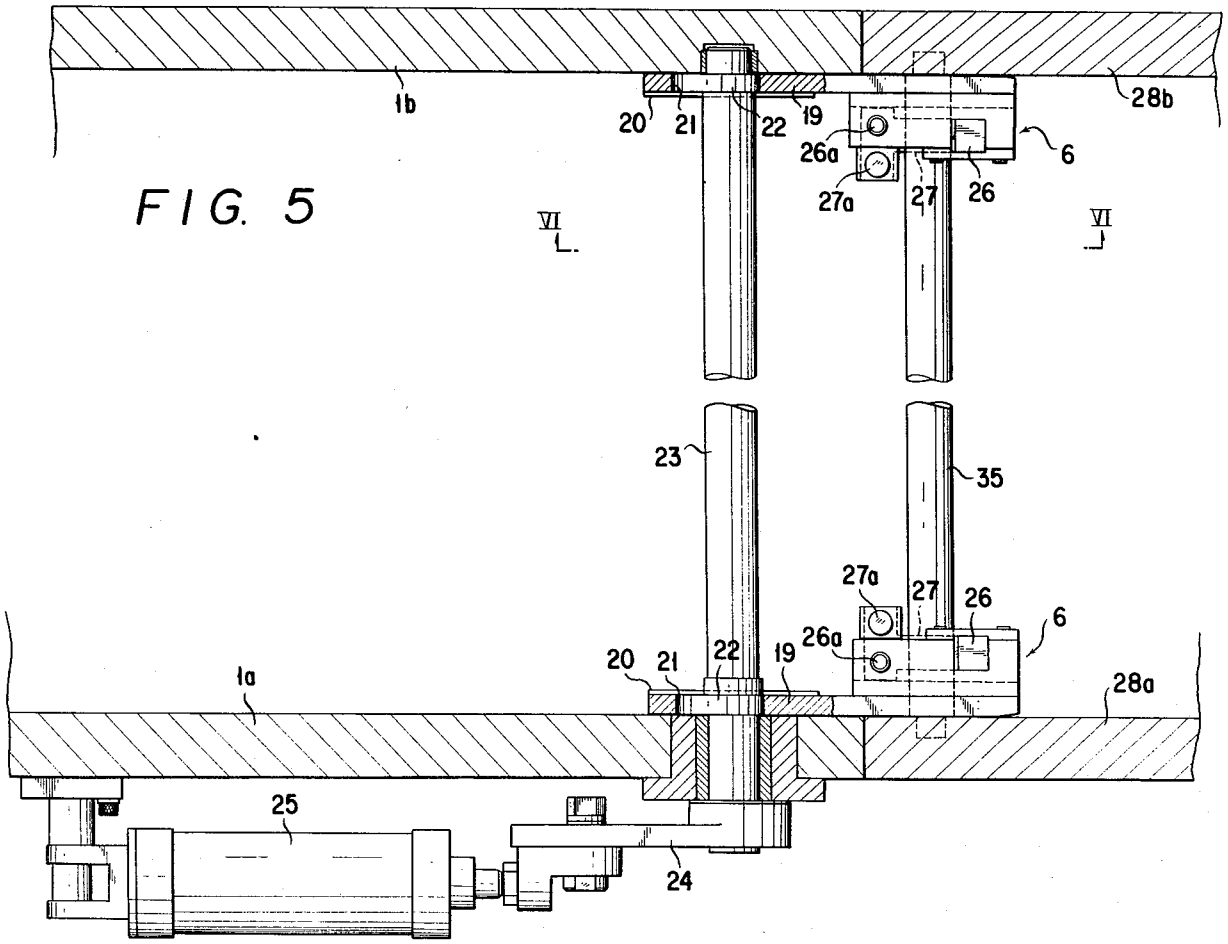
FIG. 5 is a partially cutaway plan view of a securing device for the interchangeable drum unit.
Figure 6:
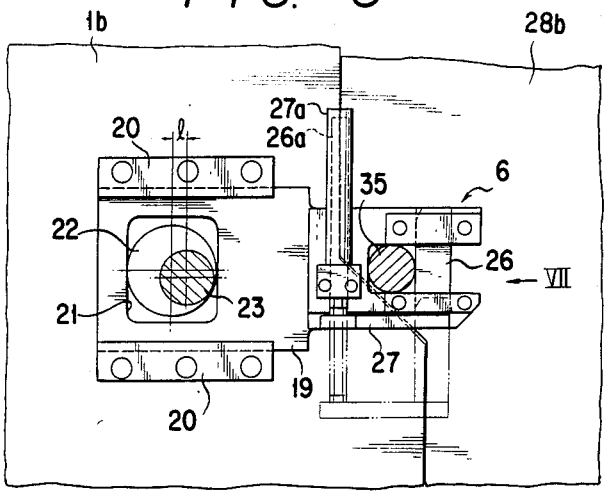
FIG. 6 is a fragmentary, longitudinal sectional view of parts of the invention taken along line IV—IV in FIG. 5.
Figure 7:
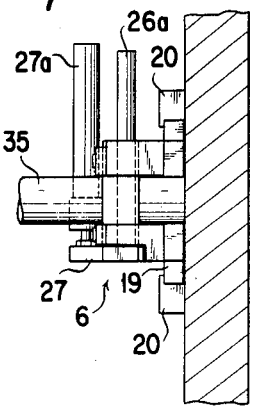
FIG. 7 is a side elevational view taken in the direction shown by arrow VII in FIG. 6.

After that, the feed wheel 13 is rotated in the direction of insertion of the interchangeable drum unit 20 (counterclockwise in FIG. 3). Consequently, the interchangeable drum unit 2 is fed in from the upper surface of the lift means 37 on the platform car 36 onto the cam followers 10 while it is being guided by the grooves 7 formed on the bottom surface of the lower part of the body frames 1*a* and 1*b*, and being kept in rolling contact with the cam followers 10. This feeding operation is stopped slightly before the completion of feeding of the interchangeable drum unit 2. In this condition, the stationary shaft 35 of the interchangeable drum unit 2 is fitted in the yoke shaped portions of the sliding pieces 19 of the fixing devices 6, which are kept in projecting condition, and the outside surfaces of both the sliding pieces 19 are brought into contact with the inside surfaces of the interchangeable drum unit frames 28*a* and 28*b* so that the transverse positioning of the interchangeable drum unit 2 can be made.

Subsequently, the air cylinder means 12 of the interchangeable drum unit moving devices 5 are actuated so as to extend their piston rods to move the cam followers 10 down. Consequently, the lower ends of the frames 28*a* and 28*b* of the interchangeable drum unit 2 are brought into contact with the bottom surface 4 of the lower part of the interchangeable drum unit mounting portion 3 of the body 1. Whilst, the locking rods 26 mounted on the yoke shaped portions of the sliding pieces 19 of the fixing devices 6 are moved in the closing direction by means of the air cylinder means 27*a* so as to engage the stationary shaft 35 of the interchangeable drum unit 2 with the sliding pieces 19 in the direction of insertion of the interchangeable drum unit 2. Subsequently, the air cylinder means 25 of the fixing means 6 is actuated to extend its piston rod so as to retract the sliding pieces 19.

By the aforementioned operation, the interchangeable drum unit 2 is mounted in the interchangeable drum unit mounting portion 3 of the rotary printing machine.

In the aforementioned operation, the downward movement of the roller followers 10 of the interchangeable drum unit moving devices 5 may be done after the completion of the fixing operation by means of the fixing devices 6.

(II) Dismounting of interchangeable drum unit:

To dismount the interchangeable drum unit 2, which is mounted on the printing machine body and is in use, from the mounting portion 3 for the purpose of replacing it with another interchangeable drum unit, it is made by effecting the aforementioned operation reversely.

It is to be noted that the foregoing description is merely illustrative of a preferred embodiment of the present invention, and that the invention is not to be limited thereto, but is to be determined by the scope of the appended claims.

What is claimed is:

1. An interchangeable drum unit type rotary printing machine comprising: a rotary printing machine body having an approximately U-shaped longitudinal interchangeable drum unit mounting portion formed substantially in the intermediate part of the front of the rotary printing machine body and having a pair of left and right body frames spaced apart with each body frame on one side thereof, the arrangement being such that an interchangeable drum unit having a plurality of transversely extending blanket and plate cylinders supported between a pair of left and right interchangeable drum unit frames spaced apart with each drum unit frame on one side thereof is mounted transversely in the mounting portion so that it may be replaced with another interchangeable drum unit; an interchangeable drum unit adapted to be mounted in said interchangeable drum unit mounting portion; a pair of left and right interchangeable drum unit moving devices mounted on said left and right body frames adapted to move an interchangeable drum unit resting on an interchangeable drum unit carriage located in close proximity to the front of said printing machine body into said mounting portion formed in the printing machine body and to move an interchangeable drum unit mounted in said mounting portion onto said carriage; and a pair of left and right interchangeable drum unit fixing devices for fixedly securing an interchangeable drum unit inserted in said mounting portion to the printing machine body.

2. An interchangeable drum unit type rotary printing machine as claimed in claim 1, wherein said interchangeable drum unit comprises a pair of left and right projecting members fixedly secured to the lower end faces of said pair of left and right interchangeable drum unit frames so as to extend along the lower end faces; a plurality of feed blocks fixedly secured to the lower end of the inside surface of each of said pair of interchangeable drum unit frames in a horizontal row and at intervals of equal spacing; and a stationary shaft located at the rear of the interchangeable drum unit and extending transversely between said pair of interchangeable drum unit frames; and further each of said interchangeable drum unit moving devices comprises a guide groove formed on the bottom surface of the lower part of said interchangeable drum unit mounting portion and located on said left body frame or said right body frame, said guide groove extending in the direction of insertion and removal of the interchangeable drum unit so as to fit therein one or the other projecting member of said interchangeable drum unit; a plurality of turning shafts mounted on the outside surface of said body frame located adjacent to and below the guide groove, at right angles thereto and in a horizontal row and at intervals of equal spacing; a plurality of eccentric cams formed integrally with the inner ends of the turning shafts and located in said groove; a plurality of roller followers fitted outside of the eccentric cams, respectively, so as to rotate freely; a plurality of levers, one end of each of which is fixedly secured to the outer end of each of said plurality of turning shafts; a connecting lever for connecting the other end of each of the levers; a first actuator whose leading end is pivotally connected to the other end of one of said plurality of levers and whose base or trailing end is pivotally connected to the side surface of said body frame; a feed wheel located in the lower part of the entrance of said interchangeable drum unit mounting portion and supported rotatably on a shaft fixedly secured to the inside surface of the body frame so as to project inside of said body frame; a driven sprocket supported on the support shaft of the feed wheel and connected integrally to the feed wheel so as to rotate synchronously with the feed wheel; and a rotating drive means for rotatively driving the driven sprocket; and each of said interchangeable drum unit fixing devices comprises a sliding piece located at an approximately longitudinally intermediate part of said interchangeable drum unit mounting portion and inwardly relative to the direction of insertion and removal of the interchangeable drum unit so as to be connected to the stationary shaft mounted on said interchangeable drum unit, said sliding piece being arranged to be guided by a horizontal guide, which is fixedly secured to the inside surface of said left body frame or said right body frame, and slidably supported in the horizontal direction; a common turning shaft having as an integral unit thereof an eccentric cam, which is inserted rotatably in an aperture formed in one end of the sliding piece and extending transversely, between said pair of left and right body frames; a lever whose one end is connected to one end of said turning shaft projecting outside of one of the body frames; a second actuator whose leading end is pivotally connected to the other end of said lever and whose base or trailing end is pivotally connected to the outside surface of said body frame at a proper position so as to turn said lever; and a locking mechanism mounted on the leading end of said sliding piece.

3. An interchangeable drum unit type rotary printing machine as claimed in claim 2, wherein said locking mechanism comprises a yoke shaped portion provided at the leading end of said sliding piece and adapted to be engaged with the stationary shaft mounted on the rear part of said interchangeable drum unit; a locking rod provided at the leading end of the yoke shaped portion in such a manner that it may be slidably moved freely in the perpendicular direction; a guide rod fitted loosely in the base end of said yoke shaped portion in such a manner that it may be slidably moved freely in the perpendicular direction; and a third actuator mounted on the base end of said yoke shaped portion in such a manner that piston rod maya be extended and retracted in the perpendicular direction and connected through a connecting member to said locking rod.

4. An interchangeable drum unit types rotary printing machine as claimed in claim 2, characterized in that the rear inside surface of each of said pair of left and right interchangeable drum unit frames is kept in close contact and in opposed relationship to the outside surface of the sliding piece of each of said interchangeable drum unit fixing devices.

* * * * *